US007068234B2

(12) United States Patent
Sievenpiper

(10) Patent No.: US 7,068,234 B2
(45) Date of Patent: Jun. 27, 2006

(54) META-ELEMENT ANTENNA AND ARRAY

(75) Inventor: Daniel F. Sievenpiper, Santa Monica, CA (US)

(73) Assignee: HRL Laboratories, LLC, Malibu, CA (US)

( * ) Notice: Subject to any disclaimer, the term of this patent is extended or adjusted under 35 U.S.C. 154(b) by 12 days.

(21) Appl. No.: 10/792,411

(22) Filed: Mar. 2, 2004

(65) Prior Publication Data

US 2004/0227667 A1 Nov. 18, 2004

Related U.S. Application Data

(60) Provisional application No. 60/470,027, filed on May 12, 2003.

(51) Int. Cl.
*H01Q 9/00* (2006.01)

(52) U.S. Cl. ..... 343/745; 343/750

(58) Field of Classification Search ..... 343/745, 343/750, 833, 834, 909, 700 MS, 754, 755, 343/756, 795

See application file for complete search history.

(56) References Cited

U.S. PATENT DOCUMENTS

| | | | |
|---|---|---|---|
| 3,267,480 A | 8/1966 | Lerner | 343/911 |
| 3,560,978 A | 2/1971 | Himmel et al. | 343/106 |

(Continued)

FOREIGN PATENT DOCUMENTS

| | | |
|---|---|---|
| DE | 196 00 609 A1 | 4/1997 |
| EP | 0 539 297 | 4/1993 |
| EP | 1 158 605 A1 | 11/2001 |
| FR | 2 785 476 | 5/2000 |
| GB | 1145208 | 3/1969 |
| GB | 2 281 662 | 3/1995 |
| GB | 2 328 748 | 3/1999 |
| JP | 61-260702 | 11/1986 |
| WO | 94/00891 | 1/1994 |
| WO | 96/29621 | 9/1996 |
| WO | 98/21734 | 5/1998 |
| WO | 99/50929 | 10/1999 |
| WO | 00/44012 | 7/2000 |
| WO | 01/31737 | 5/2001 |
| WO | 01/73891 A1 | 10/2001 |
| WO | 01/73893 A1 | 10/2001 |
| WO | 03/098732 A | 11/2003 |

OTHER PUBLICATIONS

U.S. Appl. No. 10/786,736, filed Feb. 24, 2000, Schaffner et al.

U.S. Appl. No. 10/792,412, filed Mar. 2, 2004, Sievenpiper.

U.S. Appl. No. 10/836,966, filed Apr. 30, 2004, Sievenpiper.

U.S. Appl. No. 10/844,104, filed May 11, 2004, Sievenpiper et al.

Balanis, C., "Aperture Antennas," *Antenna Theory, Analysis and Design*, 2nd Edition, Ch. 12, pp. 575–597 (1997).

Balanis, C., "Microstrip Antennas," *Antenna Theory, Analysis and Design*, 2nd Edition, Ch. 14, pp. 722–736 (1997).

Bialkowski, M.E., et al., "Electronically Steered Antenna System for the Australian Mobilesat," *IEE Proc.–Microw. Antennas Propag.*, vol. 143, No. 4, p. 347–352 (Aug. 1996).

(Continued)

*Primary Examiner*—Hoang V. Nguyen
(74) *Attorney, Agent, or Firm*—Ladas & Parry, LLP

(57) ABSTRACT

An antenna having at least one main element and a plurality of parasitic elements. At least some of the elements have coupling elements or devices associated with them, the coupling elements or devices being tunable to thereby control the degree of coupling between adjacent elements. Controlling the degree of coupling allows a lobe associated with the antenna to be steered.

23 Claims, 7 Drawing Sheets

U.S. PATENT DOCUMENTS

| | | | | |
|---|---|---|---|---|
| 3,810,183 | A | 5/1974 | Krutsinger et al. | 343/708 |
| 3,961,333 | A | 6/1976 | Purinton | 343/872 |
| 4,045,800 | A | 8/1977 | Tang et al. | 343/854 |
| 4,051,477 | A | 9/1977 | Murphy et al. | 343/700 MS |
| 4,119,972 | A | 10/1978 | Fletcher et al. | 343/844 |
| 4,123,759 | A | 10/1978 | Hines et al. | 343/854 |
| 4,124,852 | A | 11/1978 | Steudel | 343/854 |
| 4,127,586 | A | 11/1978 | Rody et al. | 260/308 B |
| 4,150,382 | A | 4/1979 | King | 343/754 |
| 4,173,759 | A | 11/1979 | Bakhru | 343/100 |
| 4,189,733 | A | 2/1980 | Malm | 343/100 SA |
| 4,217,587 | A | 8/1980 | Jacomini | 343/100 SA |
| 4,220,954 | A | 9/1980 | Marchland | 343/113 R |
| 4,236,158 | A | 11/1980 | Daniel | 343/100 LE |
| 4,242,685 | A | 12/1980 | Sanford | 343/770 |
| 4,266,203 | A | 5/1981 | Saudreau et al. | 333/21 A |
| 4,308,541 | A | 12/1981 | Seidel et al. | 343/786 |
| 4,367,475 | A | 1/1983 | Schiavone | 343/767 |
| 4,370,659 | A | 1/1983 | Chu et al. | 343/772 |
| 4,387,377 | A | 6/1983 | Kandler | 343/756 |
| 4,395,713 | A | 7/1983 | Nelson et al. | 343/713 |
| 4,443,802 | A | 4/1984 | Mayes | 343/729 |
| 4,590,478 | A | 5/1986 | Powers et al. | 343/700 MS |
| 4,594,595 | A | 6/1986 | Struckman | 343/770 |
| 4,672,386 | A | 6/1987 | Wood | 343/770 |
| 4,684,953 | A | 8/1987 | Hall | 343/725 |
| 4,700,197 | A | 10/1987 | Milne | 343/837 |
| 4,737,795 | A | 4/1988 | Nagy et al. | 343/712 |
| 4,749,996 | A | 6/1988 | Tresselt | 343/700 MS |
| 4,760,402 | A | 7/1988 | Mizuno et al. | 343/713 |
| 4,782,346 | A | 11/1988 | Sharma | 343/795 |
| 4,803,494 | A | 2/1989 | Norris et al. | 343/770 |
| 4,821,040 | A | 4/1989 | Johnson et al. | 343/700 MS |
| 4,835,541 | A | 5/1989 | Johnson et al. | 343/713 |
| 4,843,400 | A | 6/1989 | Tsao et al. | 343/700 MS |
| 4,843,403 | A | 6/1989 | Lalezari et al. | 343/767 |
| 4,853,704 | A | 8/1989 | Diaz et al. | 343/767 |
| 4,903,033 | A | 2/1990 | Tsao et al. | 343/700 MS |
| 4,905,014 | A | 2/1990 | Gonzalez et al. | 343/909 |
| 4,916,457 | A | 4/1990 | Foy et al. | 343/770 |
| 4,922,263 | A | 5/1990 | Dubost et al. | 343/797 |
| 4,958,165 | A | 9/1990 | Axford et al. | 343/770 |
| 5,021,795 | A | 6/1991 | Masiulis | 343/700 MS |
| 5,023,623 | A | 6/1991 | Kreinheder et al. | 343/725 |
| 5,070,340 | A | 12/1991 | Diaz | 343/767 |
| 5,081,466 | A | 1/1992 | Bitter, Jr. | 343/767 |
| 5,115,217 | A | 5/1992 | McGrath et al. | 333/246 |
| 5,146,235 | A | 9/1992 | Frese | 343/895 |
| 5,158,611 | A | 10/1992 | Ura et al. | 106/499 |
| 5,208,603 | A | 5/1993 | Yee | 343/909 |
| 5,235,343 | A | 8/1993 | Audren et al. | 343/816 |
| 5,268,696 | A | 12/1993 | Buck et al. | 342/372 |
| 5,268,701 | A | 12/1993 | Smith | 343/767 |
| 5,278,562 | A | 1/1994 | Martin et al. | 342/1 |
| 5,287,116 | A | 2/1994 | Iwasaki et al. | 343/700 MS |
| 5,287,118 | A | 2/1994 | Budd | 343/909 |
| 5,402,134 | A | 3/1995 | Miller et al. | 343/742 |
| 5,406,292 | A | 4/1995 | Schnetzer et al. | 343/700 MS |
| 5,519,408 | A | 5/1996 | Schnetzer | 343/767 |
| 5,525,954 | A | 6/1996 | Komazaki et al. | 333/219 |
| 5,531,018 | A | 7/1996 | Saia et al. | 29/622 |
| 5,532,709 | A | 7/1996 | Talty | 343/819 |
| 5,534,877 | A | 7/1996 | Sorbello et al. | 343/700 MS |
| 5,541,614 | A | 7/1996 | Lam et al. | 343/792.5 |
| 5,557,291 | A | 9/1996 | Chu et al. | 343/725 |
| 5,581,266 | A | 12/1996 | Peng et al. | 343/770 |
| 5,589,845 | A | 12/1996 | Yandrofski et al. | 343/909 |
| 5,600,325 | A | 2/1997 | Whelan et al. | 342/13 |
| 5,611,940 | A | 3/1997 | Zettler | 73/514.16 |
| 5,619,366 | A | 4/1997 | Rhoads et al. | 359/248 |
| 5,621,571 | A | 4/1997 | Bantli et al. | 359/529 |
| 5,638,946 | A | 6/1997 | Zavracky | 200/181 |
| 5,644,319 | A | 7/1997 | Chen et al. | 343/702 |
| 5,694,134 | A | 12/1997 | Barnes | 343/700 |
| 5,721,194 | A | 2/1998 | Yandrofski et al. | 505/210 |
| 5,767,807 | A | 6/1998 | Pritchett | 342/374 |
| 5,808,527 | A | 9/1998 | De Los Santos | 333/205 |
| 5,874,915 | A | 2/1999 | Lee et al. | 342/375 |
| 5,892,485 | A | 4/1999 | Glabe et al. | 343/789 |
| 5,894,288 | A | 4/1999 | Lee et al. | 343/770 |
| 5,905,465 | A | 5/1999 | Olson et al. | 343/700 MS |
| 5,923,303 | A | 7/1999 | Schwengler et al. | 343/853 |
| 5,926,139 | A | 7/1999 | Korisch | 343/702 |
| 5,929,819 | A | 7/1999 | Grinberg | 343/754 |
| 5,943,016 | A | 8/1999 | Snyder, Jr. et al. | 343/700 MS |
| 5,945,951 | A | 8/1999 | Monte et al. | 343/700 MS |
| 5,949,382 | A | 9/1999 | Quan | 343/767 |
| 5,966,096 | A | 10/1999 | Brachat | 343/700 MS |
| 5,966,101 | A | 10/1999 | Haub et al. | 343/767 |
| 6,005,519 | A | 12/1999 | Burns | 343/700 MS |
| 6,005,521 | A | 12/1999 | Suguro et al. | 343/700 MS |
| 6,008,770 | A | 12/1999 | Sugawara | 343/767 |
| 6,016,125 | A | 1/2000 | Johansson | 343/702 |
| 6,028,561 | A | 2/2000 | Takei | 343/767 |
| 6,028,692 | A | 2/2000 | Rhoads et al. | 359/245 |
| 6,034,644 | A | 3/2000 | Okabe et al. | 343/767 |
| 6,034,655 | A | 3/2000 | You | 345/60 |
| 6,037,905 | A | 3/2000 | Koscica et al. | 343/701 |
| 6,040,803 | A | 3/2000 | Spall | 343/700 MS |
| 6,046,655 | A | 4/2000 | Cipolla | 333/137 |
| 6,046,659 | A | 4/2000 | Loo et al. | 333/362 |
| 6,054,659 | A | 4/2000 | Lee et al. | 200/181 |
| 6,061,025 | A | 5/2000 | Jackson et al. | 343/700 MS |
| 6,075,485 | A | 6/2000 | Lilly et al. | 343/700 MS |
| 6,081,235 | A | 6/2000 | Romanofsky et al. | 343/700 MS |
| 6,081,239 | A | 6/2000 | Sabet et al. | 343/753 |
| 6,097,263 | A | 8/2000 | Mueller et al. | 333/17.1 |
| 6,097,343 | A | 8/2000 | Goetz et al. | 343/708 |
| 6,118,406 | A | 9/2000 | Josypenko | 343/700 MS |
| 6,118,410 | A | 9/2000 | Nagy | 343/713 |
| 6,127,908 | A | 10/2000 | Bozler et al. | 333/246 |
| 6,150,989 | A | 11/2000 | Aubry | 343/767 |
| 6,154,176 | A | 11/2000 | Fathy et al. | 343/700 MS |
| 6,166,705 | A | 12/2000 | Mast et al. | 343/853 |
| 6,175,337 | B1 | 1/2001 | Jasper, Jr. et al. | 343/770 |
| 6,175,723 | B1 | 1/2001 | Rothwell, III | 455/63 |
| 6,188,369 | B1 | 2/2001 | Okabe et al. | 343/767 |
| 6,191,724 | B1 | 2/2001 | McEwan | 342/21 |
| 6,198,438 | B1 | 3/2001 | Herd et al. | 343/700 MS |
| 6,198,441 | B1 | 3/2001 | Okabe et al. | 343/702 |
| 6,204,819 | B1 | 3/2001 | Hayes et al. | 343/702 |
| 6,218,912 | B1 | 4/2001 | Mayer | 333/106 |
| 6,218,997 | B1 | 4/2001 | Lindenmeier et al. | 343/725 |
| 6,246,377 | B1 | 6/2001 | Aiello et al. | 343/700 |
| 6,252,473 | B1 | 6/2001 | Ando | 333/105 |
| 6,285,325 | B1 | 9/2001 | Nalbandian et al. | 343/700 MS |
| 6,307,519 | B1 | 10/2001 | Livingston et al. | 343/767 |
| 6,317,095 | B1 | 11/2001 | Teshirogi et al. | 343/785 |
| 6,323,826 | B1 | 11/2001 | Sievenpiper et al. | 343/909 |
| 6,331,257 | B1 | 12/2001 | Loo et al. | 216/13 |
| 6,337,668 | B1 | 1/2002 | Ito et al. | 343/833 |
| 6,366,254 | B1 | 4/2002 | Sievenpiper et al. | 343/700 |
| 6,373,349 | B1 | 4/2002 | Gilbert | 333/126 |
| 6,380,895 | B1 | 4/2002 | Moren et al. | 343/700 MS |
| 6,388,631 | B1 | 5/2002 | Livingston et al. | 343/767 |
| 6,392,610 | B1 | 5/2002 | Braun et al. | 343/876 |
| 6,404,390 | B1 | 6/2002 | Sheen | 343/700 MS |
| 6,404,401 | B1 | 6/2002 | Gilbert et al. | 343/780 |
| 6,407,719 | B1 | 6/2002 | Ohira et al. | 343/893 |
| 6,417,807 | B1 | 7/2002 | Hsu et al. | 343/700 MS |

| | | | | |
|---|---|---|---|---|
| 6,424,319 | B1 | 7/2002 | Ebling et al. | 343/911 L |
| 6,426,722 | B1 | 7/2002 | Sievenpiper et al. | 343/700 MS |
| 6,440,767 | B1 | 8/2002 | Loo et al. | 438/52 |
| 6,469,673 | B1 | 10/2002 | Kaiponen | 343/703 |
| 6,473,362 | B1 | 10/2002 | Gabbay | 367/119 |
| 6,483,480 | B1 | 11/2002 | Sievenpiper et al. | 343/909 |
| 6,496,155 | B1 | 12/2002 | Sievenpiper et al. | 343/770 |
| 6,515,635 | B1 | 2/2003 | Chiang et al. | 343/834 |
| 6,518,931 | B1 | 2/2003 | Sievenpiper | 343/700 |
| 6,525,695 | B1 * | 2/2003 | McKinzie, III | 343/756 |
| 6,538,621 | B1 | 3/2003 | Sievenpiper et al. | 343/909 |
| 6,552,696 | B1 | 4/2003 | Sievenpiper et al. | 343/909 |
| 6,624,720 | B1 | 9/2003 | Allison et al. | 333/105 |
| 6,642,889 | B1 | 11/2003 | McGrath | 343/700 MS |
| 6,657,525 | B1 | 12/2003 | Dickens et al. | 335/78 |
| 6,864,848 | B1 | 3/2005 | Sievenpiper | 343/767 |
| 6,897,810 | B1 | 5/2005 | Dai et al. | 343/700 MS |
| 2001/0035801 | A1 | 11/2001 | Gilbert | 333/126 |
| 2002/0036586 | A1 | 3/2002 | Gothard et al. | 342/374 |
| 2003/0122721 | A1 | 7/2003 | Sievenpiper | 343/767 |
| 2003/0193446 | A1 * | 10/2003 | Chen | 343/893 |
| 2003/0222738 | A1 | 12/2003 | Brown et al. | 359/529 |
| 2003/0227351 | A1 | 12/2003 | Sievenpiper | 333/105 |
| 2004/0113713 | A1 | 6/2004 | Zipper et al. | 333/103 |
| 2004/0135649 | A1 | 7/2004 | Sievenpiper | 333/105 |
| 2004/0227583 | A1 | 11/2004 | Shaffner et al. | 333/32 |
| 2004/0227667 | A1 | 11/2004 | Sievenpiper | 343/700 MS |
| 2004/0227668 | A1 | 11/2004 | Sievenpiper | 343/700 MS |
| 2004/0227678 | A1 | 11/2004 | Sievenpiper | 343/702 |
| 2004/0263408 | A1 | 12/2004 | Sievenpiper et al. | 343/757 |

OTHER PUBLICATIONS

Bradley, T.W., et al., "Development Of A Voltage–Variable Dielectric (VVD), Electronic Scan Antenna," *Radar 97*, Publication No. 449, pp. 383–385 (Oct. 1997).

Chen, P.W., et al., "Planar Double–Layer Leaky–Wave Microstrip Antenna," *IEEE Transactions on Antennas and Propagation*, vol. 50, pp. 832–385 (2002).

Chen, Q., et al., "FDTD diakoptic design of a slot–loop antenna excited by a coplanar waveguide," *Proceedings of the 25th European Microwave Conference 1995*, vol. 2, Conf. 25, pp. 815–819 (Sep. 4, 1995).

Cognard, J., "Alignment of Nematic Liquid Crystals and Their Mixtures," *Mol. Cryst. Liq., Cryst. Suppl. 1*, pp. 1–74 (1982).

Doane, J.W., et al., "Field Controlled Light Scattering from Nematic Microdroplets," *Appl. Phys. Lett.*, vol. 48, pp. 269–271 (Jan. 1986).

Ellis, T.J., et al., "MM–Wave Tapered Slot Antennas on Micromachined Photonic Bandgap Dielectrics," *1996 IEEE MTT–S International Microwave Symposium Digest*, vol. 2, pp. 1157–1160 (1996).

Grbic, A., et al., "Experimental Verification of Backward–Wave Radiation From A Negative Refractive Index Metamaterial," *Journal of Applied Physics*, vol. 92, No. 10, pp. 5930–5935 (Nov. 15, 2002).

Hu, C.N., et al., "Analysis and Design of Large Leaky–Mode Array Employing The Coupled–Mode Approach," *IEEE Transactions on Microwave Theory and Techniques*, vol. 49, No. 4, pp. 629–636 (Apr. 2001).

Jablonski, W., et al., "Microwave Schottky Diode With Beam–Lead Contacts," *13th Conference on Microwaves, Radar and Wireless Communications*, MIKON–2000, vol. 2, pp. 678–681 (2000).

Jensen, M.A., et al., "EM Interaction of Handset Antennas and a Human in Personal Communications," *Proceedings of the IEEE*, vol. 83, No. 1, pp. 7–17 (Jan. 1995).

Jensen, M.A., et al., "Performance Analysis of Antennas for Hand–Held Transceivers Using FDTD," *IEEE Transactions on Antennas and Propagation*, vol. 42, No. 8, pp. 1106–1113 (Aug. 1994).

Lee, J.W., et al., "TM–Wave Reduction From Grooves In A Dielectric–Covered Ground Plane," *IEEE Transactions on Antennas and Propagation*, vol. 49, No. 1, pp. 104–105 (Jan. 2001).

Linardou, I., et al., "Twin Vivaldi Antenna Fed By Coplanar Waveguide," *Electronics Letters*, vol. 33, No. 22, pp. 1835–1837 (1997).

Malherbe, A., et al., "The Compensation of Step Discontinues in TEM–Mode Transmission Lines," *IEEE Transactions on Microwave Theory and Techniques*, vol. MTT–26, No. 11, pp. 883–885 (Nov. 1978).

Maruhashi, K., et al., "Design and Performance of a Ka–Band Monolithic Phase Shifter Utilizing Nonresonant FET Switches," *IEEE Transactions on Microwave Theory and Techniques*, vol. 48, No. 8, pp. 1313–1317 (Aug. 2000).

Perini, P., et al., "Angle and Space Diversity Comparisons in Different Mobile Radio Environments," *IEEE Transactions on Antennas and Propagation*, vol. 46, No. 6, pp. 764–775 (Jun. 1998).

Ramo, S., et al., *Fields and Waves in Communication Electronics*, 3rd Edition, Sections 9.8–9.11, pp. 476–487 (1994).

Rebeiz, G.M., et al., "RF MEMS Switches and Switch Circuits," *IEEE Microwave Magazine*, pp. 59–71 (Dec. 2001).

Schaffner, J., et al., "Reconfigurable Aperture Antennas Using RF MEMS Switches for Multi–Octave Tunability and Beam Steering," *IEEE Antennas and Propagation Society International Sympsosium, 2000 Digest*, vol. 1 of 4, pp. 321–324 (Jul. 16, 2000).

Semouchkina, E., et al., "Numerical Modeling and Experimental Study of A Novel Leaky Wave Antenna," *Antennas and Propagation Society*, IEEE International Symposium, vol. 4, pp. 234–237 (2001).

Sievenpiper, D., et al., "Eliminating Surface Currents With Metallodielectric Photonic Crystals," *1998 MTT–S International Microwave Symposium Digest*, vol. 2, pp. 663–666 (Jun. 7, 1998).

Sievenpiper, D., et al., "High–Impedance Electromagnetic Surfaces with a Forbidden Frequency Band," *IEEE Transactions on Microwave Theory and Techniques*, vol. 47, No. 11, pp. 2059–2074 (Nov. 1999).

Sievenpiper, D., et al., "High–Impedance Electromagnetic Surfaces," *Ph.D. Dissertation*, Dept. Of Elecrical Engineering, University of California, Los Angeles, CA, pp. i–xi, 1–150 (1999).

Sievenpiper, D., et al., "Low–Profile, Four–Sector Diversity Antenna on High–Impedance Ground Plane," *Electronics Letters*, vol. 36, No. 16, pp. 1343–1345 (Aug. 3, 2000).

Bushbeck, M.D., et al., "a Tunable Switcher Dielectric Grating," *IEEE Microwave and Guided Wave Letters*, vol. 3, No. 9, pp. 296–298 (Sep. 1993).

Chambers, B., et al., "Tunable Radar Absorbers Using Frequency Selective Surfaces," *11th International Conference on Antennas and Propagation*, vol. 50, pp. 832–835 (2002).

Chang, T.K., et al., "Frequency Selective Surfaces on Biased Ferrite Substrates," *Electronics Letters*, vol. 30, No. 15, pp. 1193–1194 (Jul. 21, 1994).

Gianvittorio, J.P., et al., "Reconfigurable MEMS–enabled Frequency Selective Surfaces," *Electronic Letters*, vol. 38, No. 25, pp. 1627–1628 (Dec. 5, 2002).
Lima, A.C., et al., "Tunable Frequency Selective Surfaces Using Liquid Substrates," *Electronic Letters*, vol. 30, No. 4, pp. 281–282 Feb. 17, 1994).
Oak, A.C., et al. "A Varactor Tuned 16 Element MESFET Grid Oscillator," *Antennas and Propagation Society International Symposium*, pp. 1296–1299 (1995).
U.S. Appl. No. 10/944,032, filed Sep. 17, 2004, Sievenpiper.
Brown, W.C., "The History of Power Transmission by Radio Waves," *IEEE Transactions on Microwave Theory and Techniques*, vol. MTT–32, No. 9, pp. 1230–1242 (Sep. 1984).
Fay, P., et al., "High–Performance Antimonide–Based Heterostructure Backward Diodes for Millimeter–Wave Detection," *IEEE Electron Device Letters*, vol. 23, No. 10, pp. 585–587 (Oct. 2002).
Gold, S.H.,et al., "Review of High–Power Microwave Source Research," *Rev. Sci. Instrum.*, vol. 68, No. 11, pp. 3945–3974 (Nov. 1997).
Koert, P., et al., "Millimeter Wave Technology for Space Power Beaming," *IEEE Transactions on Microwave Theory and Techniques*, vol. 40, No. 6, pp. 1251–1258 (Jun. 1992).
Lezec, H.J., et al., "Beaming Light from a Subwavelength Aperture," *Science*, vol. 297, pp. 820–821 (Aug. 2, 2002).
McSpadden, J.O.,et al., "Design and Experiments of a High–Conversion–Efficiency 5.8–GHz Rectanna," *IEEE Transactions on Microwave Theory and Techniques*, vol. 46, No. 12, pp. 2053–2060 (Dec. 1998).
Schulman, J.N., et al., "Sb–Heterostructure Interband Backward Diodes,"*IEEE Electron Device Letters*, vol. 21, No. 7, pp. 353–355 (Jul. 2000).
Sievenpiper, D.F., et al., "Two–Dimensional Beam Steering Using an Electrically Tunable Impedance Surface," *IEEE Transactions on Antennas and Propagation*, vol. 51, No. 10, pp. 2713–2722 (Oct. 2003).
Strasser, B., et al., "5.8–GHz Circularly Polarized Rectifying Antenna for Wireless Microwave Power Transmission," *IEEE Transactions on Microwave Theory and Techniques*, vol. 50, No. 8, pp. 1870–1876 (Aug. 2002).
Swartz, N., "Ready for CDMA 2000 1xEV–Do?," *Wireless Review*, 2 pages total (Oct. 29, 2001).
Yang, F.R., et al., "A Uniplanar Compact Photonic–Bandgap(UC–PBG) Structure and its Applications for Microwave Circuits," *IEEE Transactions on Microwave Theory and Techniques*, vol. 47, No. 8, pp. 1509–1514 (Aug. 1999).
Sor, J., et al., "A Reconfigurable Leaky–Wave/Patch Microstrip Aperture For Phased–Array Applications," *IEEE Transactions on Microwave Theory and Techniques*, vol. 50, No. 8, pp. 1877–1884 (Aug. 2002).
Vaughan, Mark J., et al., "InP–Based 28 $GH_x$ Integrated Antennas for Point–to–Multipoint Distribution," *Proceedings of the IEEE/Cornell Conference on Advanced Concepts in High Speed Semiconductor Devices and Circuits*, pp. 75–84 (1995).
Vaughan, R., "Spaced Directive Antennas for Mobile Communications by the Fourier Transform Method," *IEEE Transactions on Antennas and Propagation*, vol. 48, No. 7, pp. 1025–1032 (Jul. 2000).
Wang, C.J., et al., "Two–Dimensional Scanning Leaky–Wave Antenna by Utilizing the Phased Array," *IEEE Microwave and Wireless Components Letters*, vol. 12, No. 8, pp. 311–313, (Aug. 2002).
Wu, S.T., et al., "High Birefringence and Wide Nematic Range Bis–Tolane Liquid Crystals," *Appl. Phys. Lett.*, vol. 74, No. 5, pp. 344–346 (Jan. 18, 1999).
Yang, Hung–Yu David, et al., "Theory of Line–Source Radiation From A Metal– Strip Grating Dielectric–Slab Structure," *IEEE Transactions on Antennas and Propagation*, vol. 48, No. 4, pp. 556–564 (2000).
Yashchyshyn, Y., et al., The Leaky–Wave Antenna With Feroelectric Substrate, *14th International Conference on Microwaves, Radar and Wireless Communications*, MIKON–2002, vol. 2, pp. 218–221 (2002).
Sievenpiper, D., et al., "Beam Steering Microwave Reflector Based On Electrically Tunable Impedance Surface," *Electronics Letters*, vol. 38, No. 21, pp. 1237–1238 (Oct. 10, 2002).

* cited by examiner

Total Radiation

Available States

No Phase Shifter

1-Bit Phase Shifter

2-Bit Phase Shifter

3-Bit Phase Shifter

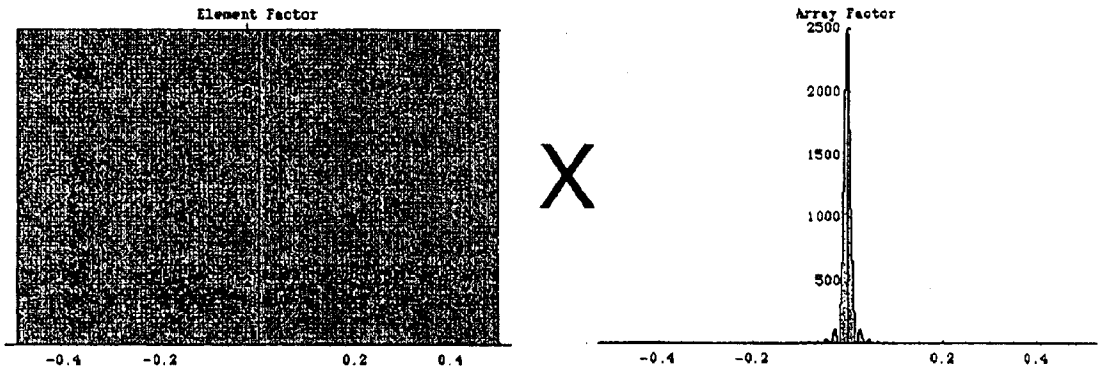
Figure 11(a):Traditional phased array antenna
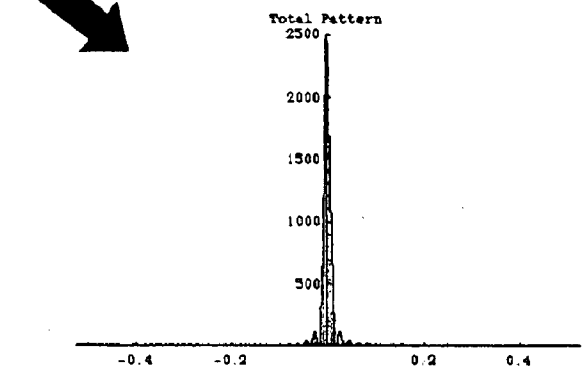
Figure 11(c): Total Pattern
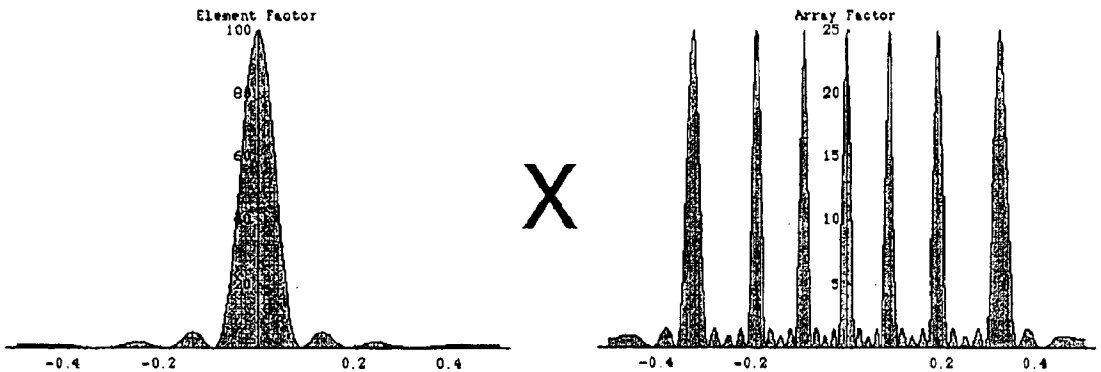
Figure 11(b): Meta-element array antenna

META-ELEMENT ANTENNA AND ARRAY

CROSS REFERENCE TO RELATED APPLICATIONS AND PATENTS

This application claims the benefit of U.S. Provisional Patent application No. 60/470,027 filed May 12, 2003, the disclosure of which is hereby incorporated herein by reference.

This application is also related to the disclosure of U.S. Provisional Patent Application Ser. No. 60/470,028 also filed on May 15, 2003 and entitled "Steerable Leaky Wave Antenna Capable of both Forward and Backward Radiation", the disclosure of which is hereby incorporated herein by reference. It is also related to a subsequently filed and related non-provisional application, which application was filed on the same date as this application (see U.S. patent application Ser. No. 10/792,412) and which application is also entitled "Steerable Leaky Wave Antenna Capable of both Forward and Backward Radiation", the disclosure of which is hereby incorporated herein by reference.

This application is also related to the disclosure of U.S. Provisional Patent Application Ser. No. 60/470,025 also filed on May 15, 2003 and entitled "Compact Tunable Antenna for Frequency Switching and Angle Diversity". It is also related to a subsequently filed and its related non-provisional application, which application was filed Apr. 30, 2004 (see U.S. patent application Ser. No. 10/836,966) and which application is entitled "Compact Tunable Antenna".

This application is also related to the disclosures of U.S. Pat. Nos. 6,496,155; 6,538,621 and 6,552,696, all to Sievenpiper et al., all of which are hereby incorporated by reference.

TECHNICAL FIELD

This technology disclosed herein relates to a steerable, planar, meta-element antenna, and an array of such meta-elements. An antenna is disclosed that comprises a radiating element that is directly fed by a radio-frequency source, and a plurality of additional elements that are coupled to each other and to the radiating element. The coupling results in radiation not only from the element that is directly fed (the main element), but also from the other elements (the parasitic elements). Because of this coupling, the effective aperture size of the meta-element is equal to its entire physical size, not just the size of the main element. The nature of the coupling between these elements can be changed, and this can be used to change the direction of the radiation.

A plurality of the meta-elements can be arranged into an array, which can have an even larger effective aperture area. Each meta-element can be addressed by a phase shifter, and those phase shifters can be addressed by a feed system, which distributes power from a transmitter to all of the meta-elements, or collects power from them for a receiver. The coupling between the elements is explicitly defined by a tunable device located on each element or between each neighboring element. Besides allowing the coupling to be tunable, this explicit coupling can be greater than would be possible with ordinary free-space coupling. This explicit and strong tunable coupling allows the antenna to be lower profile, and to have greater capabilities than is possible with other designs. The use of this coupling mechanism to perform much of the beam steering and power distribution/collection allows the antenna to be much simpler and lower cost than presently available alternatives

BACKGROUND OF INFORMATION

The technology disclosed herein improves upon two existing technologies: (1) the steerable parasitic antenna, and (2) the phased array antenna. The state of the art for steerable parasitic antennas includes a cluster of antennas, where the main antenna is fed by an RF connection and the parasitic antennas are each fed by a tunable impedance device or variable phase element. In this prior art design, the coupling between the antenna elements is constant and is provided by free-space. The feed point impedance of each of the parasitic elements is tuned, and this changes the reflection coefficient of that element. In this way, the resulting beam can be steered.

The meta-element disclosed herein operates in a somewhat similar manner, but has several advantages. In the disclosed meta-elements, the feed point impedance of the parasitic elements is constant and the coupling coefficient is provided by a tunable device, rather than by free space. This provides three advantages:

(1) The coupling coefficient can be greater because of the presence of the tunable device, allowing the antenna to be lower profile than the prior art alternative. Free space coupling requires a minimum vertical length between adjacent elements to be exposed to each other, which sets the minimum height of these elements.

(2) The use of constant (rather than tunable) feed point impedance allows greater freedom in the design of the elements. In fact, elements with no RF feed point at all can be used. This allows greater simplicity and thus lower cost.

(3) This architecture provides additional degrees of freedom compared to the prior art architecture, which allows the meta-element to have greater capabilities in the forming and steering of beams and nulls.

If M elements are arranged in a lattice, and each element has n neighbors, the prior art architecture only allows M degrees of freedom, because it is the feed-point impedance of each element that is tuned while the coupling is constant. With the architecture disclosed herein, there are potentially Men degrees of freedom because the coupling between each neighboring element can potentially be tuned separately. This greater freedom allows greater capabilities in controlling the beam angle(s), null angle(s), frequency response, and polarization of the antenna.

When used as an array of meta-elements, the disclosed meta-element provides an advantage over state-of-the-art phased arrays, because, among other things, it is simpler. It can be lighter and lower-cost, and can fill a greater number of applications. These improvements come about because the tunable coupling between the elements provides much of the beam steering and power distribution/collection of the array, thus reducing the number of required components such as phase shifters and power combiners or dividers. In addition, for the control system, a single analog line can take the place of several digital lines, reducing the total number of connections. For slow-speed scanning, the elements can be addressed by rows and columns, further simplifying the array.

The disclosed meta-element can be used in a number of applications, including next-generation vehicular communication systems, where beam steering may be needed for greater gain and for interference cancellation, low-gain steerable antennas on mobile platforms, or unmanned ground units. When used as an array of meta-elements, the technology disclosed herein can find a large number of applications as a replacement for conventional phased array antennas. Since it can be low profile and conformal, as well as low-cost, it can fit a wide variety of applications. Furthermore, there are many communication and sensing systems that are impractical today, but that would be enabled by the existence of a low-cost or lightweight phased array. For example, the ability to place a steerable, high-gain antenna on every vehicle on the battlefield would allow more sophisticated networks and enhanced data-gathering and coordination than is presently available. With a greater number of connected nodes, the value of a network is increased by the square of the number of nodes, as described by Metcalf's law.

The prior art includes existing parasitic antennas such as the Yagi-Uda array (see FIG. 1) and steerable versions such as the steerable parasitic array (see FIG. 2). It also includes phased arrays (see FIG. 9(*a*)). It also includes tunable impedance surfaces (see FIG. 4(*a*)—in the prior art the bias voltages are the same for all patches), which are one kind of a system of coupled radiators. It also includes traditional antennas consisting of systems of coupled oscillators (see FIG. 3), which are typically steered by pulling the phase of the edge elements, but often lacks a simple means of feeding the antenna with an arbitrary waveform or receiving a signal.

In general, steerable antennas are made up of several or many discrete antennas. Beam steering is typically accomplished by preceding each radiating antenna with a phase shifter. The phase shifters control the phase of the radiation from each antenna, and produce a wave front having a phase gradient, which results in the main beam being steered in a particular direction depending on the direction and magnitude of this phase gradient. If the spacing between the antennas is too large, a second beam will also be formed, which is called a grating lobe.

The minimum spacing to prevent grating lobes depends on the direction of the main beam, and it is between one-half wavelength and one wavelength. For large arrays, this results in a large number of antennas, each with its own phase shifter, resulting in a high cost and complexity. A feed structure is also required to feed all of these antennas, which further increases the cost and weight.

The prior art also includes a body of work that has appeared in various forms, and can be summarized as a lattice of small metallic particles that are linked together by switches. Such antennas can be considered as distinct from the present disclosure because the metal particles are not resonant structures by themselves, but only when assembled into a composite structure by the switches.

The prior art also includes:

1. B. Chiang, J. A. Proctor, G. K. Gothard, K. M. Gainey, J. T. Richardson, "Adaptive Antenna for Use in Wireless Communication Systems", U.S. Pat. No. 6,515,635, issued Feb. 4, 2003;
2. M. Gabbay, "Narrowband Beamformer Using Nonlinear Oscillators", U.S. Pat. No. 6,473,362, issued Oct. 29, 2002;
3. T. Ohira, K. Gyoda, "Array Antenna", U.S. Pat. No. 6,407,719, issued Jun. 18, 2002;
4. R. A. Gilbert, J. L. Butler, "Metamorphic Parallel Plate Antenna", U.S. Pat. No. 6,404,401, issued Jun. 11, 2002;
5. J. Rothwell, "Self-Structuring Antenna System with a Switchable Antenna Array and an Optimizing Controller", U.S. Pat. No. 6,175,723, issued Jan. 16, 2001;
6. T. E. Koscica, B. J. Liban, "Azimuth Steerable Antenna", U.S. Pat. No. 6,037,905, issued Mar. 14, 2000;
7. D. M. Pritchett, "Communication System and Methods Utilizing a Reactively Controlled Directive Array", U.S. Pat. No. 5,767,807, issued Jun. 16, 1998;
8. J. Audren, P. Brault, "High Frequency Antenna with a Variable Directing Radiation Pattern", U.S. Pat. No. 5,235,343, issued Aug. 10, 1993;
9. R. Milane, "Adaptive Array Antenna", U.S. Pat. No. 4,700,197, issued Oct. 13, 1987;
10. L. Himmel, S. H. Dodington, E. G. Parker, "Electronically Controlled Antenna System", U.S. Pat. No. 3,560,978, issued Feb. 2, 1971; and
11. Daniel Sievenpiper, U.S. Pat. No. 6,496,155.

BRIEF DESCRIPTION OF THE PRESENTLY DISCLOSED TECHNOLOGY

In one aspect, the presently disclosed technology provides an antenna having at least one main element; and a plurality of parasitic elements, where at least some of the elements have coupling elements or devices associated with them, the coupling elements or devices being tunable to thereby control the degree of coupling between adjacent elements.

BRIEF DESCRIPTION OF THE DRAWINGS

FIGS. 5(*b*) and 5(*d*) correspond to FIGS. 5(*a*) and 5(*c*), respectively, but show the leaky waves on the surface and departing the tunable impedance surface of FIGS. 4(*a*) and 4(*b*) with the bias or control voltages shown as a function of position;

FIG. 7(*b*) depicts the electric field profile (|E|) and the Poynting vector (S) as a function of position for a meta-element antenna with non-uniform coupling between elements that is optimized to produce radiation in a particular direction;

FIG. 8(*b*) depicts an array of meta-elements, consisting of many parasitic elements, each associated with one of several main elements;

FIG. 9(*b*) depicts an array of meta-elements in side elevation view where only the main elements are active and the rest of the elements are passive, thus simplifying the design and lowering the cost and wherein the passive elements are spaced at one-quarter wavelength and supply much of the power distribution and phase control;

FIG. 10(*b*) depicts the tunable impedance surface and the main antenna element combining to produce the total radiation (indicated by the line circling the head of the arrow);

FIG. 10(*c*) depicts various possible available states for the combined radiation;

FIGS. 10(*d*)–10(*f*) depict the possible states for a one-, two-, or three-bit phase shifter;

FIG. 11(*a*) depicts the element factor and the array factor for a traditional phased array antenna;

FIG. 11(*b*) depicts the element factor and the array factor for a meta-element antenna; and FIG. 11(*c*) depicts the total pattern of either the traditional phased array antenna or the meta-element array antenna.

DESCRIPTION OF A PREFERRED EMBODIMENT

Figure 1:
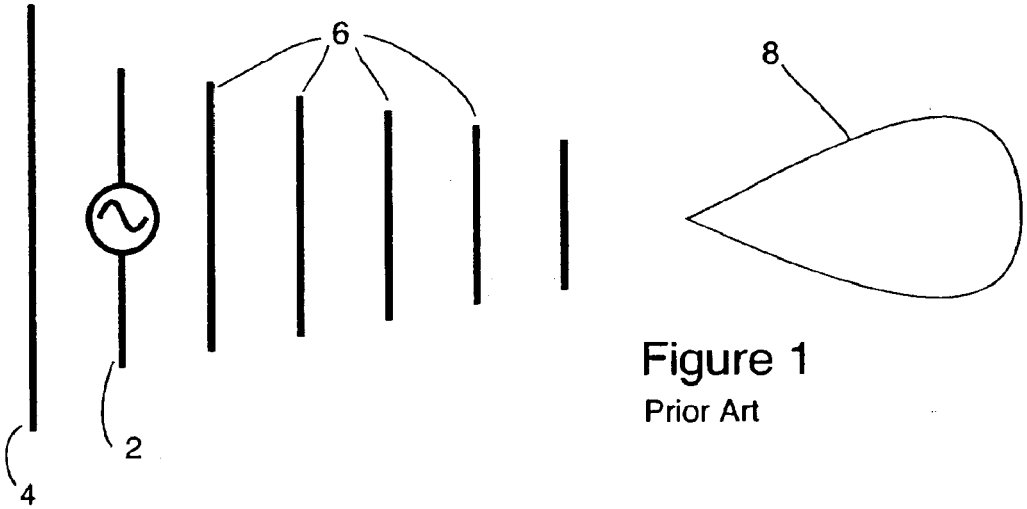
Figure 1 Prior Art
FIG. 1 depicts a convention Yagi-Uda antenna.

It has been known for decades that parasitic antenna elements can also be used for beam forming, such as the popular Yagi-Uda array 10, shown in FIG. 1. This array 10 consists of three kinds of elements: (1) a single driven element 2, (2) a reflector element 4, which is typically longer or has a lower resonance frequency than the driven element 2, and (3) a series of director elements 6, which are typically shorter or have a higher resonance frequency than the driven element 2.

The Yagi-Uda array 10 works as follows: The driven element 2 radiates power, which is received by all of the parasitic elements, which comprise the reflector element 4 and the director elements 6. These parasitic elements 4, 6 re-radiate the power with a phase that depends on the resonance frequency of the parasitic elements with respect to the frequency of the driven element 2. The radiation from the parasitic elements 4, 6 adds with the radiation from the driven element 2 with the appropriate phases to produce a beam 8 in a particular direction. If an element 6 having a higher resonant frequency lies to the left in this figure of an element 6 having a lower resonant frequency, the phases of the radiation from these two elements will produce a beam to the left, as shown. Thus, a series of elements that are tapered in size (increasing in resonance frequency) to the left will produce a beam in that direction. More elements can be added to increase the gain in the main beam 8.

Figure 2:
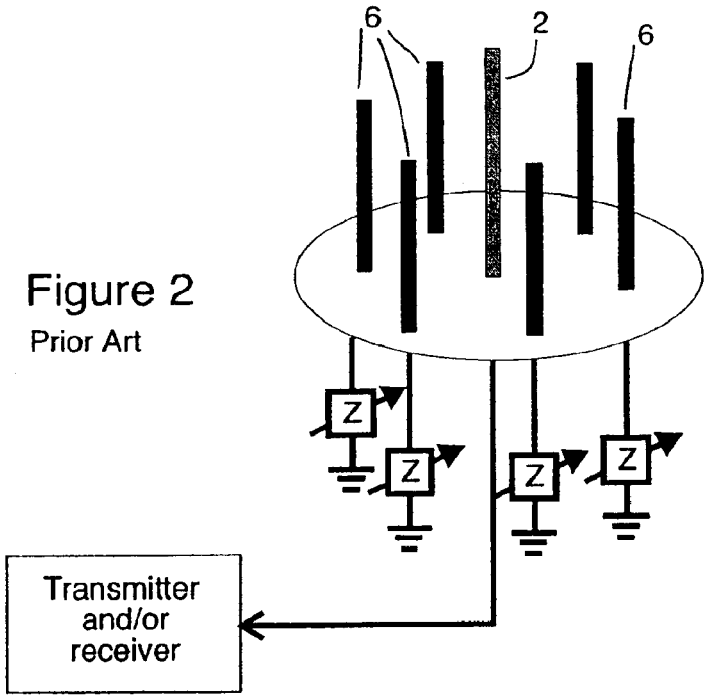
Figure 2 Prior Art
FIG. 2 depicts a two-dimensional, steerable, Yagi-Uda array.

An improvement upon the design of FIG. 1 is the design shown in FIG. 2, where a driven element 2 is surrounded by several parasitic elements 6, whose feed point impedances can be tuned. This has the effect of changing the effective resonance frequency of each element, and changing its reflection phase at the frequency of the driven element. This is a kind of two-dimensional, steerable, Yagi-Uda array. Like the traditional Yagi-Uda array 10, it relies on coupling between the elements through free space. This requires that there be a large exposed length or area between the elements to achieve significant coupling, which sets the minimum vertical size of the antenna. Most often, quarter-wave monopoles are used. Planar patch designs have also been proposed, although these are expected to have more limited steering capabilities because of the weaker coupling between elements 2, 6.

Figure 3:
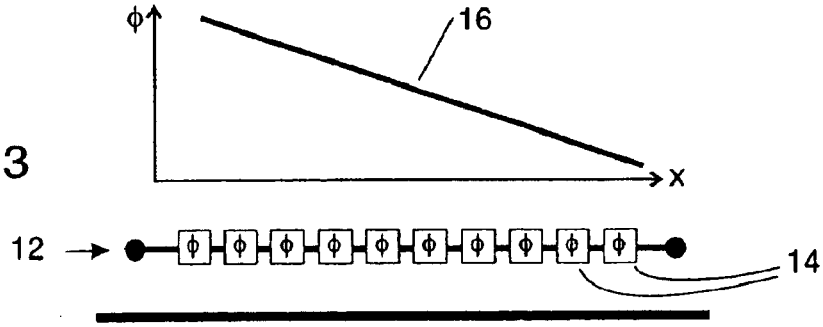
Figure 3 Prior Art
FIG. 3 depicts a coupled oscillator array that can be used for beam steering.

Antennas have also been proposed that include strong coupling between elements and that use this coupling for beam steering. These are commonly referred to as coupled oscillator arrays, and an example of such an antenna 12 is shown in FIG. 3. These typically consist of a series of oscillators 14 that produce RF power on their own—that is, they are active resonators. They are coupled to their neighboring oscillators 14 by some means, which could be simply free space coupling, but other coupling techniques could be used instead. The coupling must be strong enough that each oscillator 14 will tend to lock in phase with its neighbors. They are disposed near (typically at a distance 0.25λ from) a reflector element 13. If one oscillator is tuned out of phase, it will tend to pull both of its neighbors out of phase to some degree. This can produce a steerable beam because if the oscillators at the edge can be pulled out of phase or detuned by some external means, and this will tend to pull all of the oscillators out of phase to form a phase gradient 16. This defines a beam in a particular direction. One problem with this kind of antenna is that it works best for continuous-wave (CW) radiation, and works less well for modulated radiation. Other difficulties include providing a means to modulate the radiation from such an antenna 12, or of using the antenna 12 in a receive mode.

Figure 4A:
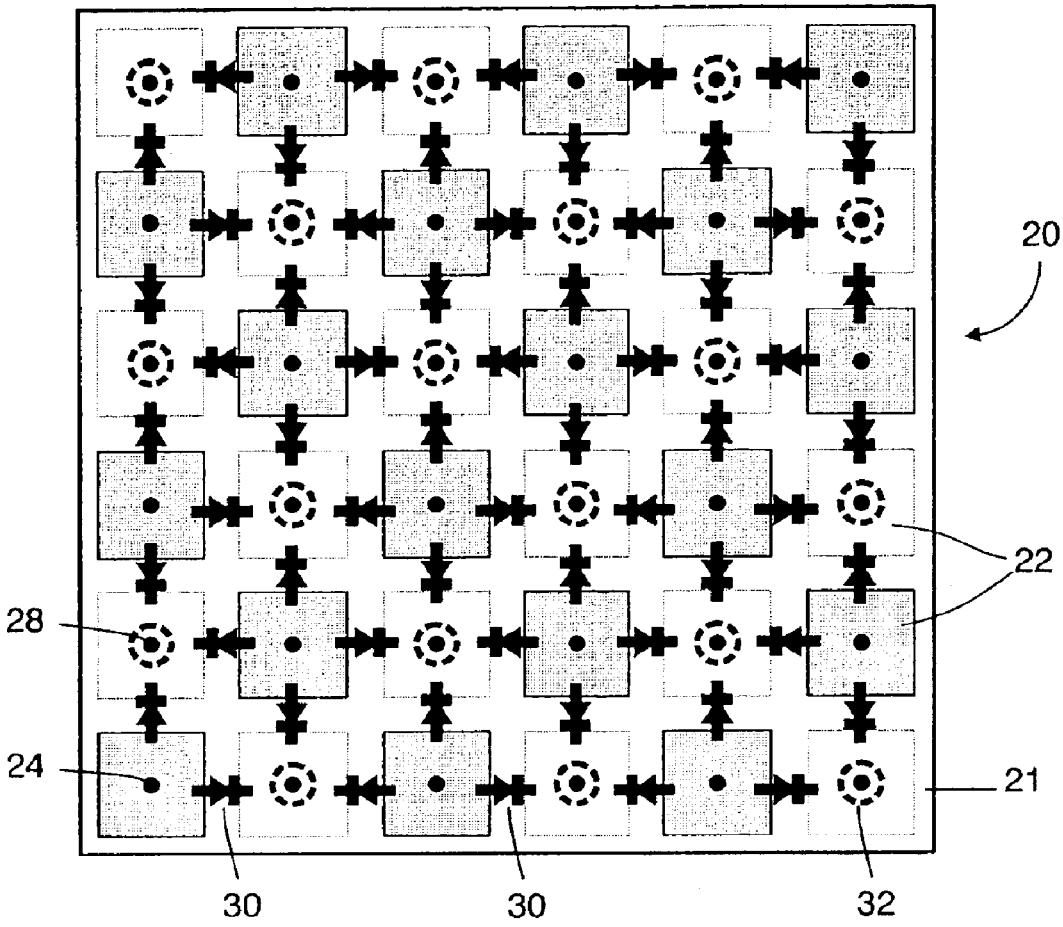
FIGS. 4(*a*) and 4(*b*) are top and side elevation views of a tunable impedance surface.
Figure 4B:
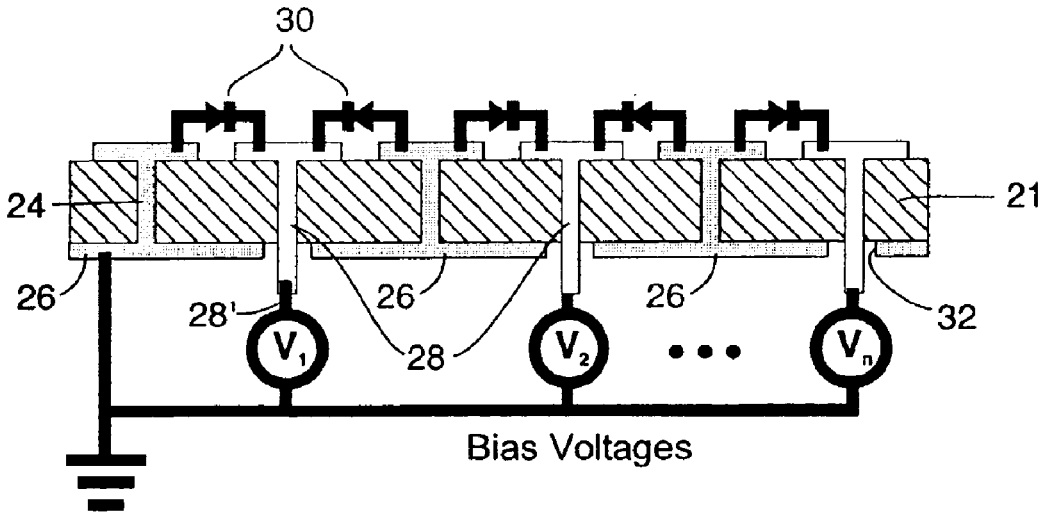
Figure 5A:
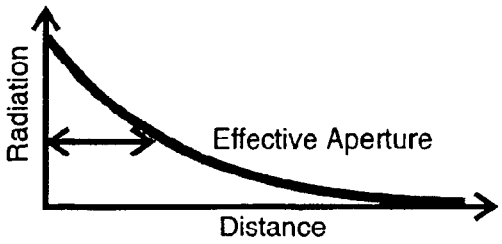
FIGS. 5(*a*) and 5(*c*) are graphs of the radiation versus distance for leaky antennas on an electrically tunable impedance surface, the impedance being uniform for FIG. 5(*a*) and non-uniform, nearly periodic for FIG. 5(*c*)
Figure 5C:
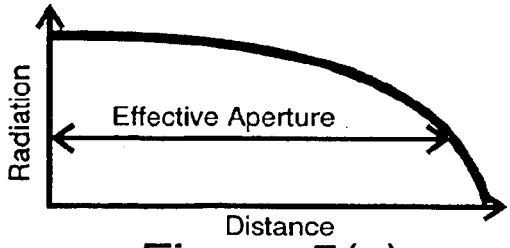
Figure 5B:
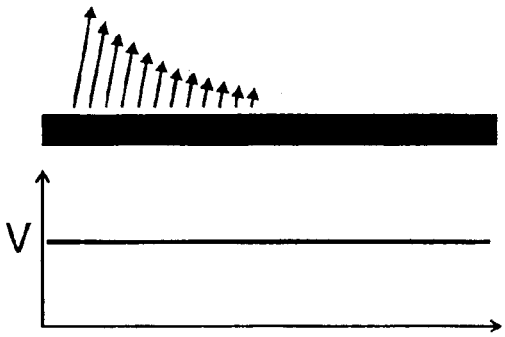
Figure 5D:
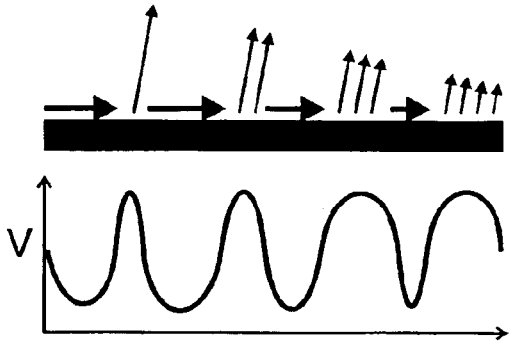

Another device that has attracted interest in the antenna art is the tunable impedance surface 20 (see FIGS. 4*a* and 4*b*), which surface is the subject of U.S. Pat. No. 6,496,155 to Sievenpiper et al. and which is further disclosed in U.S. Provisional Patent Application Ser. No. 60/470,028 to Sievenpiper et al. entitled "Steerable Leaky wave Antenna Capable of both Forward and Backward Radiation". U.S. Pat. Nos. 6,538,621 and 6,552,696 to Sievenpiper, et al, disclose other embodiments of a tunable impedance surface.

This surface 20, which can be utilized in one (but not the only) embodiment of the presently disclosed technology, is typically built as a series of metal plates 22 that are printed on a substrate 21, and a ground plane 26 on the other side of the substrate 21. Some of the plates are attached to the ground plane by metal plated vias 24, while others of the plates are attached to direct current (DC) bias lines 28' by vias 28 which penetrate the ground plane through openings 32 therein. Between adjacent patches are attached variable capacitors 30, which may be implemented as varactor diodes that control the capacitance (coupling) between the patches in response to control voltages applied thereto. The patches 22, loaded by the variable capacitors 30, have a resonance frequency that can be tuned with the applied bias or control voltages on the variable capacitors. Such a structure is shown in FIG. 4. For an antenna operating at 4.5 GHz, the substrate 21 may be, for example, a 62 mil (1.5 mm) thick dielectric substrate clad with copper and etched as shown and described with reference to FIGS. 4(*a*) and 4(*b*). Even with an antenna disposed on surface 20, the total thickness of the surface 20 and the antenna elements (see, for example, element 50 in FIGS. 6(*a*) and 6(*b*)) should be less than 2.5 mm for a 4.5 GHz antenna. This thickness is clearly less than 0.1λ and thus the antenna has a very low profile.

Moreover, while the tunable impedance surface 20 is depicted as being planar, it need not necessarily be planar. Indeed, those skilled in the art will appreciate the fact that the printed circuit board technology preferably used to provide a substrate 21 for the tunable impedance surface 20 can provide a very flexible substrate 21. Thus the tunable impedance surface 20 can be mounted on most any convenient surface and conform to the shape of that surface. The tuning of the impedance function would then be adjusted to account for the shape of that surface. Thus, surface 20 can be planar, non-planar, convex, concave or have most any other shape by appropriately tuning its surface impedance.

The surface 20 can be used for radio frequency beam steering in several modes, which are described in U.S. Pat. Nos. 6,496,155 and 6,538,621 to Sievenpiper et al. and in U.S. Provisional Patent Application Ser. No. 60/470,028 (and its subsequently filed non-provisional application identified above) to Sievenpiper et al. entitled "Steerable Leaky Wave Antenna Capable of both Forward and Backward Radiation".

One of those modes is the reflection mode, whereby a radio frequency beam is reflected by the surface from a remote source (see, for example, U.S. Pat. No. 6,538,621). The angle of the reflected beam can be steered by changing the resonance frequency of each of the cells in the surface. Because the reflection phase from each cell depends on its resonance frequency with respect to the frequency of illumination, it is possible to create a phase gradient, which steers the reflected beam. Having the tunable impedance surface operate as a surface for reflecting a beam implies that some sort of antenna, such as a horn antenna, is disposed remote from the surface so that it can illuminate the tunable impedance surface from afar. Unfortunately, such a design is impracticable in a number of applications, particularly vehicular and airborne applications.

Another mode of operation is the leaky wave mode, which is described in U.S. Provisional Patent Application Ser. No. 60/470,028 (and its subsequently filed non-provisional application identified above) to Sievenpiper et al. entitled "Steerable Leaky Wave Antenna Capable of both Forward and Backward Radiation". This mode of operation is closely related to the presently disclosed technology, in that it does not involve illuminating the tunable surface from a remote source, but instead involves launching a wave on the surface from a planar launching structure that is adjacent to the surface. In this mode, a wave known as a surface wave is launched across the surface, and in a certain frequency range this surface wave can be considered as a leaky wave, because it radiates some of its energy into the surrounding space as it propagates. Leaky wave antennas of various kinds have been described in the open literature. In this mode of operation, the tunable impedance surface differs from the previous leaky wave antennas that have been described in two important ways: (1) It can generate radiation in either or both the forward and/or backward direction. (2) The effective aperture area of such an antenna can be much greater than was typically possible with many kinds of leaky waves in the past, and in fact the effective aperture size can be controlled. These two features are achieved by applying a non-uniform voltage function to the varactors 30, which generates a non-uniform surface impedance function, which allows for control of both the magnitude and phase of the radiation across the entire surface.

Traditional leaky wave antennas suffer from the fact that the leaky wave dies out as it propagates, because it is radiating away into the surrounding space. This is shown in FIGS. 5(*a*) and 5(*b*). The effective aperture for such an antenna is limited by the decay rate of this leaky wave. It has been shown in the aforementioned US Provisional Application that this is not a required drawback of leaky wave antennas, and that it is possible to create a surface where the effective aperture is nearly the entire area of the surface, as shown by FIGS. 5(*c*) and 5(*d*). This is accomplished by using a non-uniform, nearly periodic surface impedance on surface 20, which can be considered to consist of regions producing radiation having different magnitudes and phases. By controlling the amount of radiation that leaks off the surface, the effective aperture can be extended. This has been shown in traditional leaky wave antennas, but not typically in ones that can be steered to an arbitrary direction by using a non-uniform, cyclic surface impedance on surface 20. FIG. 5(*d*) shows that controlling the bias voltages (V) on the variable capacitors in a periodic or nearly periodic manner can cause the leaky waves to be emitted across the surface.

The technique of tapering the radiation profile to extend the effective aperture of some types of antennas is known per se in the prior art. However, it is typically used for closed structures, where a wave propagates within a waveguide, and then radiates out through apertures or by other means. It is not typically used for open structures, and it has not been shown before for leaky wave antennas that are capable of steering in arbitrary directions, both forward and backward.

Figure 6A:
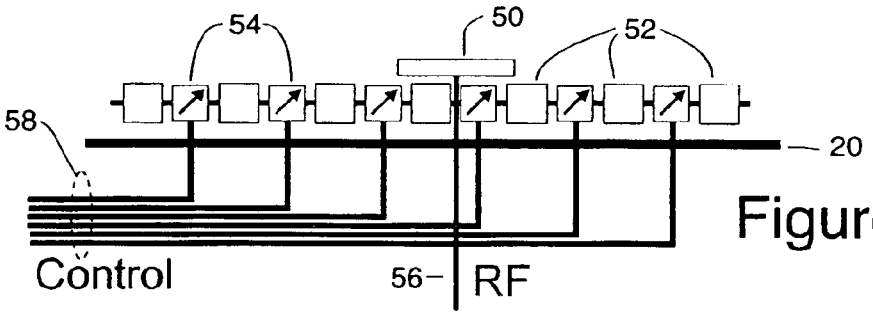
FIGS. 6(*a*) and 6(*b*) depict two embodiments of a meta-element antenna.
Figure 6B:
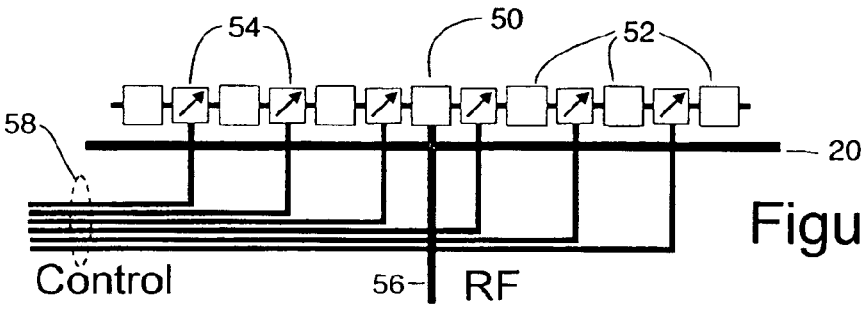

With the background information provided above whereby one can create leaky wave antennas that can steer a beam in either the forward or backward direction and that can have a large effective aperture over a wide range of beam angles, the reader is now in a better position to understand the subject matter of the presently disclosed technology. To understand the concepts disclosed herein, it is best not to consider the use of surface waves or leaky waves as they have been described above, but instead to consider a surface consisting of coupled resonant elements (which need not resemble the tunable impedance surface 20 described above, but that is one possible embodiment) and to consider an element which acts as an exciter 50 (the main element), and spreads radio frequency energy across a broad area of the other resonant elements 52 (the parasitic elements). The coupling between the elements can be of any type, but it can be tuned independently for each element or pair of adjacent elements, by a coupling element 54. The main element 50 could resemble the parasitic elements, or it could be distinct. The main element 50 is attached to an RF feed structure 56. The coupling between the elements is controlled by control lines 58, which can be connected directly to the coupling elements 54, or connected indirectly through some of the elements. Examples of these two coupling techniques are shown in FIGS. 6(*a*) and 6(*b*). In FIG. 6(*a*) one embodiment of the meta-element antenna is shown with its main element 50 distinct from the parasitic elements 52 and not necessarily disposed in the same plane as the parasitic elements 52. Another embodiment appears in FIG. 6(*b*) where the main element 50 resembles one of the parasitic elements 52 and preferably lies in the same plane as the parasitic elements 52. In both embodiments, the main element 50 is the element that is directly connected to an RF feed 56. The parasitic elements 52 are not directly connected to an RF feed 56. The coupling between the elements is controlled by a set of control wires 58, which are shown attached to the coupling devices or elements 54 between the elements 50, 52, but could be connected to the coupling devices 54 in any way, including indirectly through the elements 50, 52 themselves.

The term "meta-element" as used herein in a general sense is considered to be a combination of a main element and several parasitic elements, (i) where at least some of the elements (main and parasitic) have coupling elements or devices associated with them, (ii) where the coupling elements or devices control the degree of coupling between adjacent elements, and (iii) where the coupling elements or devices can be tuned. The elements and the coupling devices can be of any form. For example, the coupling devices can be tunable capacitors, tunable inductors, or any combination of those. They are generally small compared to the wavelength of interest, so they can generally be described using a lumped circuit model. The elements themselves can be metal patches, dipoles, dielectric resonators, or nearly any other structure that is capable of storing microwave energy, and can therefore be considered as resonant.

The meta-element has no particular height requirements or limitations. In bright contrast, the driven and parasitic elements of a traditional parasitic array are all likely to be on the order of a quarter wavelength in height, whereas the meta-element has no height requirement. One way of making a meta-element will be by means of a tunable impedance surface. Such surfaces have heights that are typically less than 0.1λ, so using known techniques to make a meta-element results in a very low profile antenna (less than 0.1λ) that is much shorter than are conventional parasitic array antennas.

In one embodiment, the tunable elements help form tunably resonant LC circuits where the tunable element is provided by a tunable capacitor associated with a tunable impedance surface, for example. In the embodiment of FIGS. 4(*a*) and 4(*b*), the tunable elements in the LC circuits are provided by tunable capacitors (preferably in the form of varactors 30) while the elongate elements 24 and 28 provide inductance and the plates 22 provide additional capacitance. Elements 28 act as if they are coupled to the ground plane 26 due to capacitive coupling at openings 32 in the ground plane 26 at the operating frequency of the antenna, but act as if isolated from the ground plane 26 at the switching frequency of the control voltages $V_1$, $V_2$ . . . $V_n$. The inductive elements 24, 28 and/or the capacitive elements 22, 30 of the LC circuits can also provide the coupling between elements.

This meta-element differs from traditional parasitic antennas in that the coupling is explicitly defined by a tunable element 54, rather than by free space, and that the feed point impedance of the parasitic elements does not need to be tuned. In fact, the parasitic elements do not need to have a feed point at all; there does not need to be a port on the parasitic elements through which RF energy could be coupled to an external device that is not directly attached to it.

In the tunable impedance surface embodiment, element 54 of FIGS. 6(*a*) and 6(*b*) can be provided by the variable capacitors 30 (preferably in the form of varactor diodes).

Figure 7A:
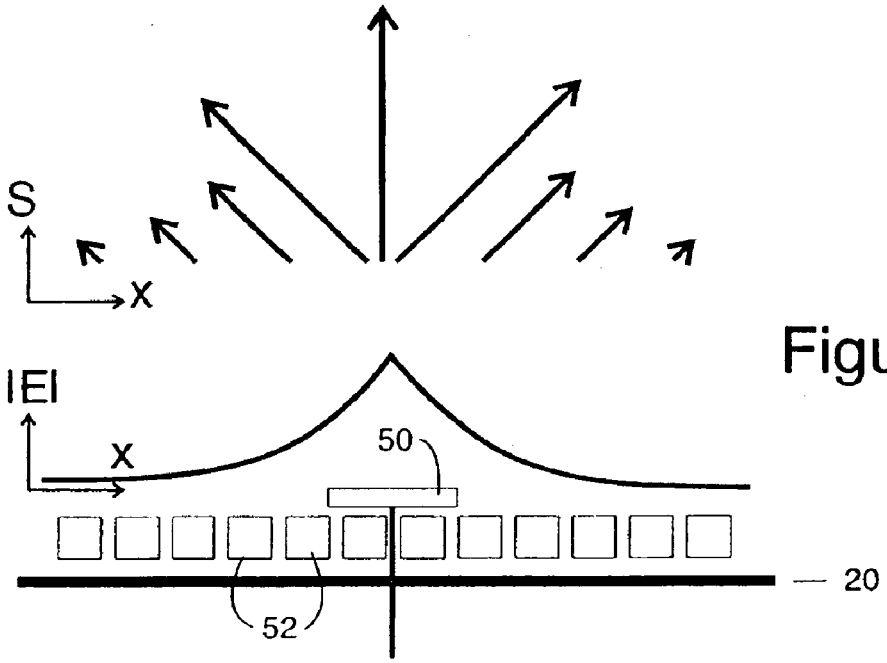
FIG. 7(*a*) depicts the electric field profile (|E|) and the Poynting vector (S) as a function of position for a meta-element antenna with uniform coupling between elements.
Figure 7B:
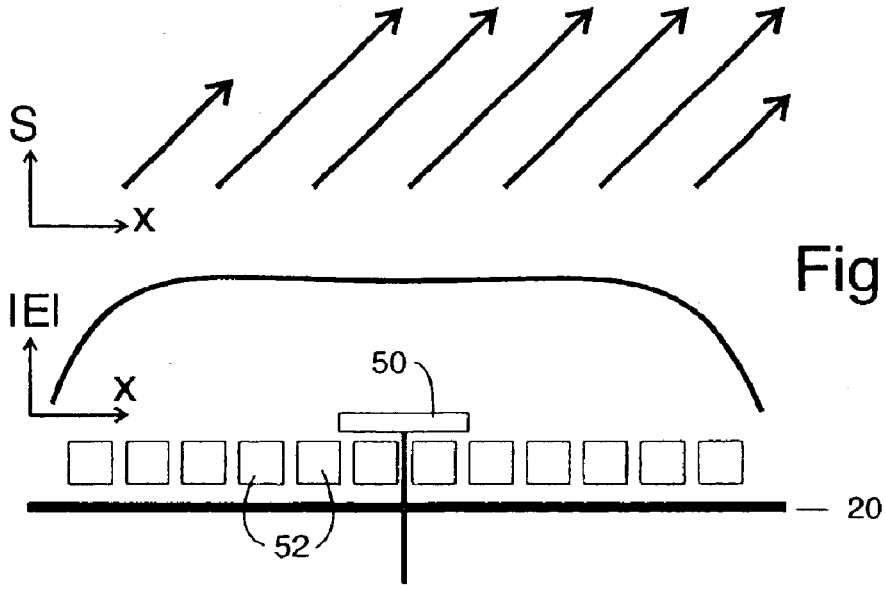

The presently disclosed technology also differs from traditional leaky wave antennas in that the driven element need not have a preferred direction. The main element 50 can be omnidirectional, and the beam from the meta-element can be steered in most any direction. FIGS. 7(*a*) and 7(*b*) show the antenna being used in two modes, which can be considered as examples of the possible modes of operation, but not the entire set of possible modes of operation. FIG. 7(*a*) graphs the electric field profile (|E|) and the Poynting vector (S) as a function of position for a meta-element with uniform coupling. FIG. 7(*b*) graphs the same parameters for a meta-element with non-uniform coupling that is optimized to produce radiation in a particular direction.

The beam direction and aperture profile (beam width) can be changed by varying the coupling between the meta-elements. The meta-element can produce a nearly omnidirectional pattern, if the coupling between the elements is set so that the field decays rapidly away from the main element. It can also be set so that it forms a narrow beam, if the coupling between the elements is set so that the field extends to the edge of the meta-element. The minimum beam width is determined by the size of the meta-element.

Figure 8A:
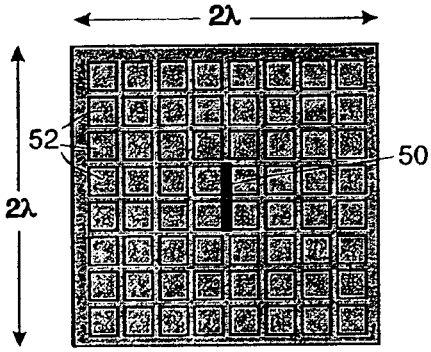
FIG. 8(*a*) depicts a single meta-element seen from the top view, consisting of a square array of coupled parasitic elements, and a dipole-like main element.
Figure 8B:
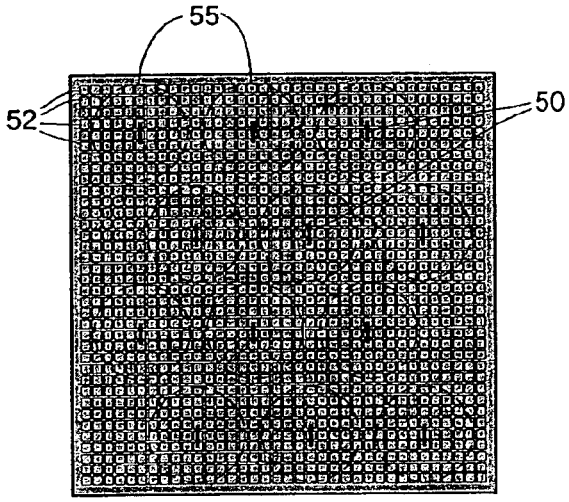

In its most basic form, the meta-element antenna described herein can be used as a low-gain steerable antenna, such as might be useful for many communication applications. An example is shown in FIG. 8(*a*), where a small cluster of parasitic elements 52 is fed by a single main element 50, as can be seen from this plan view thereof. The main element 50 may be a dipole or some other type of antenna that can serve as an exciter, or it could resemble the parasitic elements 52. The spacing of the parasitic elements 52 may be about one-quarter wavelength, so the antenna shown in FIG. 8(*a*) would be about two wavelengths square.

Varying the coupling between the parasitic elements 52 is controlled, as previously discussed, so that the surface impedance would follow a pattern like that shown in FIG. 5(*d*) circularly around an axis normal to element 50 in FIG. 8(*a*). Of course, the smaller the size of parasitic elements 52, the closer that the surface impedance can follow FIG. 5(*d*). But smaller parasitic elements 52 beget more coupling elements 54, which increase the cost of the antenna. So, while the size of the parasitic elements 52 maximizes at one-quarter wavelength of the operating frequency of the antenna, the parasitic elements 52 can be made smaller, with the realization that doing so will require more coupling elements 54 to be utilized thereby increasing the cost of manufacture of the meta-element.

In this embodiment of a tunable impedance surface embodiment discussed immediately above, the parasitic elements 52 are preferably implemented by the grounded metal plates 22 of a tunable impedance surface 30 as previously discussed with reference to FIGS. 4(*a*) and 4(*b*) while the tunable coupling elements 54 are implemented by the ungrounded metal plates and their associated variable capacitors. However, the presently disclosed technology is not limited to use with a tunable impedance surface of the type having electrically controlled capacitors. Consider FIGS. 5(*a*) and 8(*a*) again. The parasitic elements 52 can be metal patches or elements disposed in close proximity to (less than 0.1 λ away from) a ground plane 20 (and typically spaced or separated therefrom by a dielectric layer 51). The tunable coupling elements 54 can be implemented as optically controlled MEMS capacitors and fiber optic cables can implement the control lines 58. Still other devices can be used to control the impedance across the surface.

The meta-element can be one part of a multi-element array, as shown in FIG. 8(*b*) and indeed is preferably part of a multi-element array for beam steering. In this case, there are multiple main elements 50, and many parasitic elements 52. The parasitic elements 52 are arranged into groups 55, and each group is associated with a main element 50. This array of meta-elements can be arbitrarily large, and can have arbitrarily high gain, depending on its size. This array of meta-elements can fill many of the same applications as a traditional phased array, but can be made for much lower cost, because much of the beam forming and power distribution tasks are taken care of by the tunable coupling devices, and by free space.

Figure 9A:
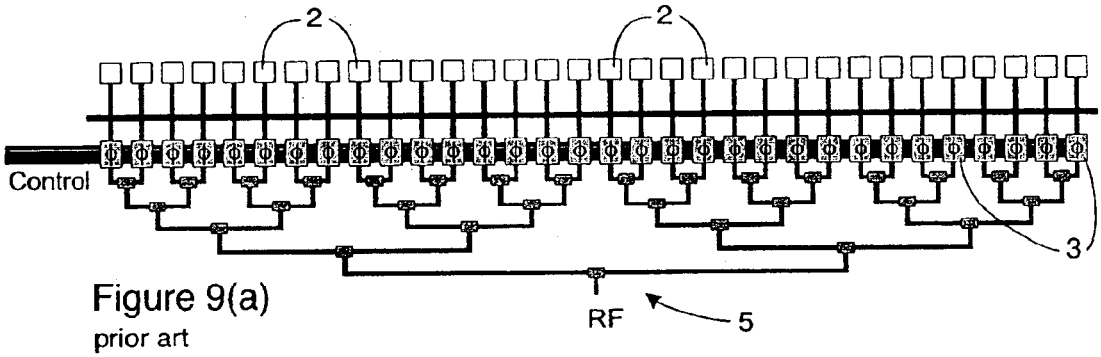
Figure 9(a) prior art
FIG. 9(*a*) depicts a traditional phased array where all elements are active, are each fed by a phase shifter and an associated feed network and where the array spacing is about one-half wavelength.
Figure 9:
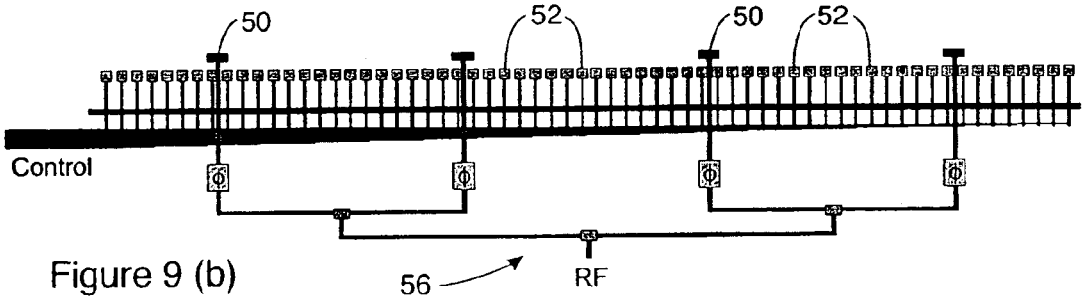
Figure 10A:
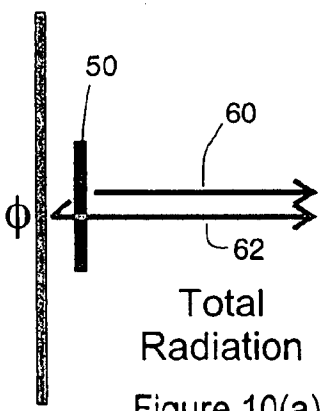
FIG. 10(*a*) is a graph of the total radiation from a system of an antenna and a reflecting surface with arbitrary phase.
Figure 10B:
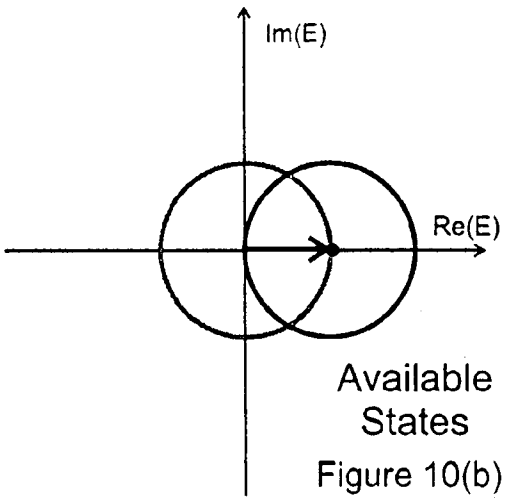
Figure 10C:
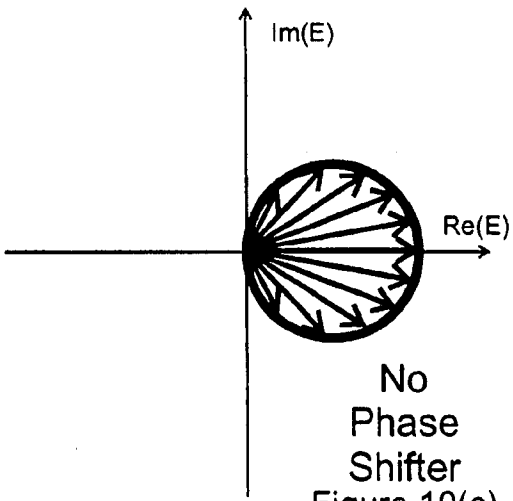
Figure 10D:
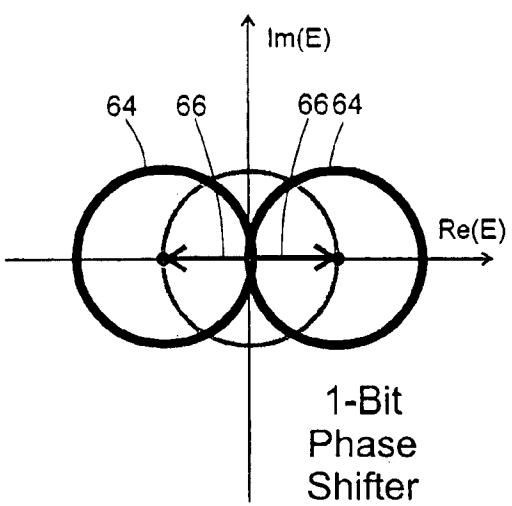
Figure 10E:
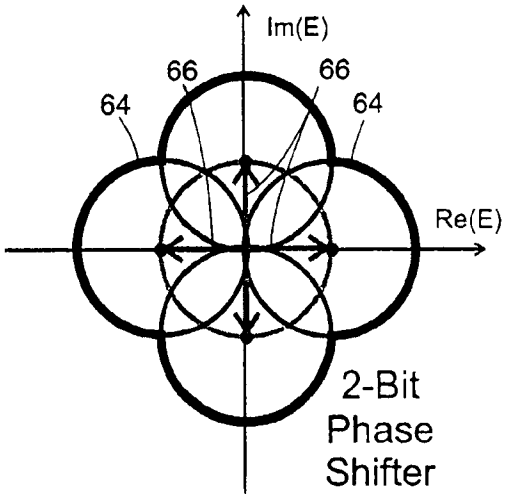
Figure 10F:
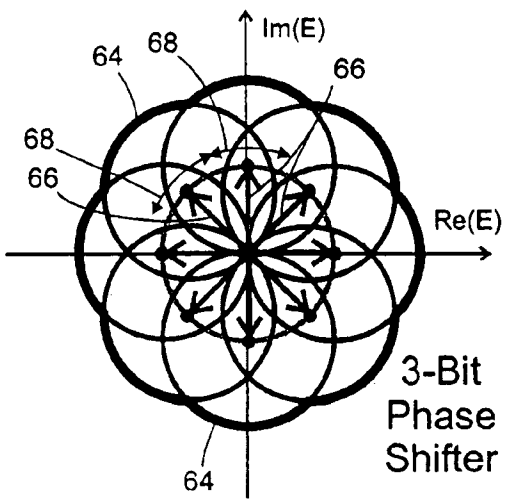

The array of meta-elements of FIG. 8(*b*) has an advantage, compared to the prior art, of a significant potential cost savings over a traditional phased array. A common array architecture used today is shown in FIG. 9(*a*). Many active elements 2 are arranged on a lattice, which elements 2 typically have one-half wavelength spacing. Each active element 2 is driven via a phase shifter 3, and signals are supplied to and collected from the elements 2 by a corporate RF feed network 5. Other architectures exist, but many of the common ones resemble some variation on this general concept.

FIG. 9(*b*) shows how the main elements 50 of the array of FIG. 8(*a*) can be controlled or driven by a RF feed network 56. The array of meta-elements, shown in FIG. 9(*b*), is much simpler and therefore has the advantage of a lower cost for the following reasons:

(1) Many of the active elements 2 in the prior art array are replaced by passive elements 52 that do not need an explicit feed or a phase shifter.

(2) Although each passive element 52 or each tuning device or element needs a control connection, this can be a single analog connection instead of multiple digital connections.

(3) Although some kind of feed network 56 is still needed, it can be much simpler because of the fewer number of directly driven elements 50. Power is distributed through free space and through the coupling among the elements 50, 52.

(4) Although some phase shifters are still needed, they are far fewer, and they can be simpler than what is needed for a traditional phased array, because the tunable elements 54 can provide much of the fine phase shift requirements, and discrete phase shifters are only required for what would normally represent the more significant bits of a traditional multi-bit phase shifter.

The simplification of the required phase shifters is now described with reference to FIGS. 10(*a*)–(*f*). For an antenna placed near a resonant array or surface, the total radiation from that antenna will consist of components that originate directly at the antenna, and components that are scattered by the array, as shown in FIG. 10(*a*). Numeral 60 leads to an arrow, which signifies the radiation from a main element while numeral 62 leads to an arrow that signifies the radiation from the parasitic elements 52. If the array can supply a phase shift on reflection that ranges from 0 to $2\pi$, then the total radiation is the combination of this scattered radiation, which can be represented as a circle where the radius of the circle is the scattered power, and the points along the circumference are the various phase states, as shown in FIG. 10(*b*). The radiation that originates directly from the antenna can be represented as a line, where the length of the line is the radiated power. The sum of the circle and the line is as shown in FIG. 10(*c*). Clearly, not all possible phase states are possible with this configuration. Of course, if it were possible to minimize the direct radiation from the antenna 60 and maximize the portion of the total radiation that is scattered by the array 62, then all or a greater number of possible phase states would be achievable, with more uniform magnitude.

FIGS. 10(*d*)–10(*f*) show the possible states that are achievable with one, two, or three bit phase shifters in the RF network 56 of FIG. 9(*b*). The total radiation is shown as a thick line 64, and the states that are achievable with only the phase shifter are shown as arrows 66. Clearly, the fact that the array supplies much of the required phase shift eases the requirements on the phase shifter. Consider the 3-bit phase shifter example of FIG. 10(*f*), for example. Here the amount of shift attributable to the 3-bit phase shifters corresponds to the eight arrows showing the different directions in which the main lobe of the array would occur. Fine shifting between these eight coarse directions is handled by tunable elements 54, the fine shifting being signified by arrows 68.

For the meta-element and array described here, the antenna in the above model can be seen as representing one of the main elements and the array or surface can be seen as representing the parasitic elements. If the radiation from the main element 50 can be minimized, then no phase shifter at all is required in the RF network 56. If the radiation from the main element 50 represents a significant amount of the total radiation from the antenna, then the situation will be as shown in FIG. 10(*a*), and a phase shifter will be required, with at least two but preferably at least three bits of control data.

The bandwidth of a meta-element is governed by its thickness, as with any resonant surface, and also by its effective area. The forming of a beam in the far field depends on the coherent combination of radiation from an area that is the effective aperture of the meta-element. This requires that energy travel from the main element to all of the parasitic elements that are participating in the radiation. Because the phase at each element is a function of frequency, it is not possible to define the same phase at each parasitic element over a broad range of frequencies. This problem gets worse as more parasitic elements participate in the radiation. Thus, for broad bandwidth operation, the meta-element should be of a smaller size. For narrow bandwidth operation, it can be of a large size, which lowers the cost per effective aperture area, particularly when used in an array of meta-elements.

Those skilled in the art might be skeptical over whether this system will work, because it would seem that the wide spacing of the main elements would produce grating lobes. However, the element to be considered here is not merely the main element 52, but rather the entire meta-element of FIG. 8(*a*), for example. Therefore, since the total pattern from the array can be considered as the product of the array pattern (or array factor) and the element pattern (or element factor), one can understand this array as one where the element pattern is highly directive and steerable. The total pattern is then the product of the array pattern (which does have grating lobes) and the highly directive element pattern (which cancels the grating lobes). See FIG. 11(*b*) where the combined effect of taking the product of the array pattern (which does have grating lobes) and the highly directive element pattern (which cancels the grating lobes) is shown graphically, resulting in a total pattern as shown in FIG. 11(*c*). FIG. 11(*a*) shows the same sort of analysis as applied to a prior art phased array antenna. Of course, the advantage of the disclosed meta-element is that it is much simpler and lower cost than the phased array. Also, due to its thinness and the ability to make the meta-elements array using printed circuit board technology, the meta-element array can be not only low profile, but also conformal thereby permitting it to conform to a curved surface such as is found on the exterior surfaces of aircraft and other vehicles, for example.

Having described the presently disclosed technology in connection with certain embodiments thereof, modification will now certainly suggest itself to those skilled in the art.

As such, the presently disclosed technology is not to be limited to the disclosed embodiments except as required by the appended claims

What is claimed is:

1. An antenna comprising:

(a) at least one main driven antenna element; and (b) a plurality of parasitic antenna elements, where at least some of the parasitic antenna elements have coupling elements or devices associated with them for electrically coupling said at least some of the parasitic antenna elements to said one main driven antenna element, the coupling elements or devices being tunable to control a degree of coupling between adjacent antenna elements.

2. The antenna of claim 1 wherein the coupling devices are tunable capacitors.

3. The antenna of claim 1 wherein the coupling devices have a physical size which is much smaller than a wavelength of a normal operating frequency of the antenna, so they can be described using a lumped circuit model.

4. The antenna of claim 1 wherein the main driven element is selected from the group consisting of metal patches, dipoles, dielectric resonators, and other resonant structures capable of emitting microwave energy.

5. The antenna of claim 1 wherein the at least one main driven antenna element and the plurality of parasitic antenna elements are disposed in a two dimensional array spaced from a ground plane, the at least one main element and the plurality of parasitic antenna elements being spaced from the ground plane by a distance no greater than one tenth of a wavelength of a normal operating frequency of the antenna.

6. The antenna of claim 5 wherein the parasitic antenna elements are formed by an array of metal plates disposed on a dielectric medium.

7. The antenna of claim 6 wherein the coupling elements are variable capacitors.

8. The antenna of claim 7 wherein the variable capacitors are MEMS capacitors.

9. The antenna of claim 7 wherein the variable capacitors are varactors.

10. The antenna of claim 1 wherein the antenna has a plurality of said main driven antenna elements with each main driven antenna element having an associated group of parasitic antenna elements and having an associated phase shifter, the associated phase shifter providing a relatively coarse lobe directional control for said antenna and the associated group of parasitic antenna elements providing a relatively fine lobe directional control for said antenna.

11. The antenna of claim 10 wherein the plurality of main driven antenna elements and the plurality of groups of parasitic antenna elements are disposed in a two dimensional array spaced from a ground plane, the plurality of main driven antenna elements and the plurality of groups of parasitic antenna elements being spaced from the ground plane by a distance no greater than one tenth of a wavelength of a normal operating frequency of the antenna.

12. The antenna of claim 11 wherein the plurality of groups of parasitic antenna elements are formed by a two dimensional array of conductive plates disposed on a dielectric medium.

13. The antenna of claim 12 wherein the plurality of main driven antenna elements are formed by an array of elongate conductive elements, the elongate conductive elements each having a length which is longer than a maximum dimension of one of said conductive plates.

14. The antenna of claim 12 wherein the plurality of main driven antenna elements are formed by an array of conductive elements, the elongate conductive elements each having outer dimensions which are approximately the same as one of said conductive plates.

15. The antenna of claim 11 wherein the coupling elements are variable capacitors.

16. The antenna of claim 15 wherein the variable capacitors are MEMS capacitors.

17. The antenna of claim 16 wherein the variable capacitors are varactors.

18. A method of steering an antenna comprising:

disposing at least one main antenna element and a plurality of parasitic antenna elements in an array adjacent a ground plane, where at least some of the antenna elements have coupling elements or devices associated with them; and adjusting the coupling elements or devices to thereby control the degree of coupling between adjacent antenna elements in said array whereby the degree of coupling varies cyclically in radial directions away from said at least one main antenna element in said array.

19. The method of claim 18 wherein the coupling elements include variable capacitors and wherein adjusting of the coupling elements is performed by tuning the variable capacitors.

20. The method of claim 19 wherein the variable capacitors are MEMS capacitors.

21. The method of claim 19 wherein the variable capacitors are varactor diodes.

22. The method of claim 18 wherein the at least one main element and the plurality of parasitic elements are spaced from the ground plane by a distance no greater than one tenth of a wavelength of a normal operating frequency of the antenna.

23. The method of claim 22 wherein the antenna has a plurality of said main elements with each main element having an associated group of parasitic elements and having an associated phase shifter and further including (a) adjusting the phases of the phase shifters to thereby provide a relatively coarse lobe directional control for said antenna and (b) wherein adjusting the coupling elements or devices to thereby control the degree of coupling between adjacent elements in the groups of parasitic elements provide a relatively fine lobe directional control for said antenna.

* * * * *